United States Patent [19]

Edwards et al.

[11] Patent Number: 4,965,832

[45] Date of Patent: Oct. 23, 1990

-[54] ACTIVE NOISE CONTROL

[75] Inventors: John W. Edwards, Middlesex; Nicolaas M. J. Dekker, Midhurst, both of United Kingdom

[73] Assignee: The General Electric Company, p.l.c., England

[21] Appl. No.: 342,315

[22] Filed: Apr. 25, 1989

[30] Foreign Application Priority Data

Apr. 29, 1988 [GB] United Kingdom ..... 8810236.3

[51] Int. Cl.[5] ..... G10K 11/16

[52] U.S. Cl. ..... 381/71

[58] Field of Search ..... 381/71, 94

[56] References Cited

U.S. PATENT DOCUMENTS 4,677,676 6/1987 Eriksson ..... 381/71

FOREIGN PATENT DOCUMENTS 1492963 11/1977 United Kingdom .
1548362 7/1979 United Kingdom .
2054999 2/1981 United Kingdom .
2088951 6/1982 United Kingdom .
2147166 5/1985 United Kingdom .
2149273 6/1985 United Kingdom .

*Primary Examiner*—Forester W. Isen
*Attorney, Agent, or Firm*—Kirschstein, Ottinger, Israel & Schiffmiller

[57] ABSTRACT

An active noise control system for controlling noise propagated through a duct comprises a first microphone located to receive the propagated noise at a point in a plane perpendicular to the length of the duct. A loudspeaker is located substantially at that plane for introducing sound into the duct. An analog first control circuit is operative in response to the noise received by the first microphone to feed a signal to the loudspeaker such that the sound introduced thereby destructively interferes with the noise at that point. A second microphone is located further downstream to receive residual noise propagated along the duct despite the destructive interference. A second control circuit, responsive to the residual noise received by the second microphone, controls parameters of the analog first control circuit so as to minimize the residual noise. In particular, the first control circuit includes an integrator which has a transfer function which is electrically controlled by the second control circuit.

10 Claims, 1 Drawing Sheet

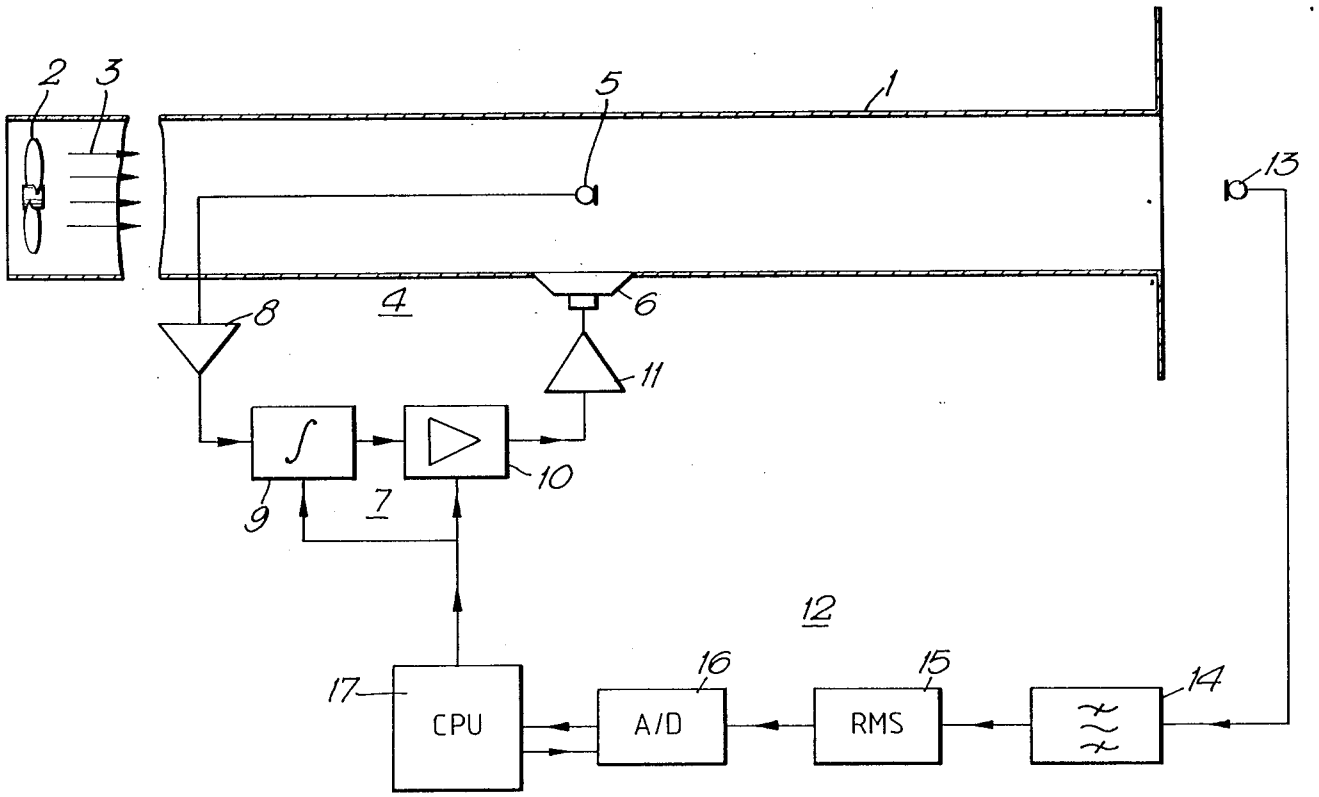
RMS
A/D
CPU

ACTIVE NOISE CONTROL

BACKGROUND OF THE INVENTION

1. Field of the Invention;

This invention relates to the control of noise which is propagated along a duct, for example by the action of a fan associated with the duct.

2. Description of Related Art

It has long been known that the level of such noise can be reduced by locating a receiving transducer, such as a microphone, to sense the noise at a position in the duct, locating a transmitting transducer, such as a loudspeaker, to introduce sound into the duct, amplifying and changing the phase of the output of the microphone and feeding the resulting signal to the loudspeaker so that the sound introduced into the duct by the loudspeaker destructively interferes with the noise at the microphone position. The noise level at that position, and downstream of that position, is thereby reduced.

A problem with such basic active noise control systems is that a filter or other compensating means must be used in the circuit which feeds the loudspeaker, in order to compensate for the characteristics of the feedback path within the duct, between the loudspeaker and the microphone, and this compensating means needs adjustment to compensate for changes in the feedback path to obtain the best noise attenuation which can be achieved while ensuring that the system does not howl.

It has previously been proposed to provide a feedback "management" system in which a second microphone is located downstream of the loudspeaker to pick up any residual noise, and thereby to produce a signal which is then used to control the feedback circuit to minimise the residual noise. This will detect any tendency for the feedback circuit to howl, and will operate to counteract it.

In the previous active noise control systems in which such management has been effected, the whole of the feedback loop has been digitally controlled. This has required the microphone and the loudspeaker to be displaced relative to each other along the duct by such a distance as will correspond to the time delay which is caused by the digital processing circuitry. The fact that the whole of the feedback system and the management system has operated digitally has meant that expensive digital circuitry is required.

SUMMARY OF THE INVENTION

It is an object of the present invention to provide a stable analog active noise control system.

According to the invention there is provided an active noise control system comprising a duct through which noise to be controlled can propagate from a noise source; first receiving transducer means located to receive the propagated noise at a point in a plane perpendicular to the length of the duct; transmitting transducer means located substantially at said plane for introducing sound into the duct; analog first control means operative in response to the noise received by said first receiving transducer means to feed a signal to the transmitting transducer means such that the sound introduced thereby destructively interferes with the noise at said point, said first control means including integrating circuit means having an electrically-controllable transfer fucntion; second receiving transducer means located further from the noise source than said plane to receive residual noise propagated along the duct despite said destructive interference; and second control means, responsive to the residual noise received by said second receiving transducer means, to control parameters of said first analog control means so as to minimise said residual noise.

BRIEF DESCRIPTION OF THE DRAWINGS

An embodiment of the invention will now be described, by way of example, with reference to the accompanying figure, which is a schematic block diagram of an active noise control system in accordance with the invention.

DETAILED DESCRIPTION OF THE PREFERRED EMBODIMENT

Referring to the FIGURE, a duct 1, such as a duct in a heating/ventilation system, is coupled to a fan 2 which feeds air along the duct in the direction of arrows 3. As a result of the operation of the fan, noise is propagated along the duct towards the right in the figure, and such noise may be disturbing to occupants of the building.

In order to reduce the level of the propagated noise, an active noise control system 4 is provided. This comprises a microphone 5 which is located to receive the noise at a point downstream of the fan, a loudspeaker 6 which is at substantially the same distance along the duct as the microphone, and a feedback circuit 7 interconnecting the microphone and the loadspeaker. The feedback circuit comprises an amplifier 8 which receives the output of the microphone 5 and which feeds an amplified signal to a controllable integrator 9. The integrator signal is fed to a controllable electronic attenuator 10, the output of which is coupled to a power amplifier 11. The output of the amplifier 11 drives the loudspeaker 6.

It will be apparent that the whole of the active noise control loop from the microphone 5 to the loudspeaker 6 operates in an analog mode.

The operation of the integrator 9 and the attenuator 10, and hence the effectiveness of the active noise control system, is controlled by a management system 12, which includes a second microphone 13 which is located downstream of the microphone 5 to receive any residual noise which may be propagated along the duct 1. The output of the microphone 13 is fed to a bandpass filter 14 and thence to an RMS detection circuit 15. The output of the circuit 15 is fed to an analog/digital converter 16, which provides a digital signal upon which a central processing unit (CPU) 17 operates. The CPU 17 controls the integrator 9 and the attenuator 10.

In operation of the circuit, any residual noise received by the microphone 13 will cause the CPU 17 to adjust the integrator 9 to achieve the required phase shift between the sound introduced into the duct by the loudspeaker 6 and the noise which is to be cancelled at the position of the microphone 5, to obtain optimum noise cancellation, while avoiding howling of the circuit. The CPU also adjusts the attenuation factor of the attenuator 10, thereby controlling the loop gain of the feedback path, for optimum noise cancellation.

The algorithms required for adjusting the integrator 9 and the attenuator in dependence upon the parameters of the residual noise can be implemented by the CPU 17 using programs stored in the CPU memory.

Various alternative configurations would be possible within the scope of the invention. For example, the noise propagated along the duct might be generated by another source instead of the fan 2. The positions of the microphone 5 and the loudspeaker 6 could be interchanged. The microphone 13 may lie beyond the end of the duct 1 to sense the residual noise emanating from the duct, as shown, or it might be located anywhere within the duct, provided that it is at least slightly downstream of the microphone 5 and the loudspeaker 6. Other receiving and transmitting transducer might be used in place of the microphones 5, 13 and the loudspeaker 6. Although the CPU 17 is described as operating from digital signals, it could alternatively operate in an analog mode. The A/D converter 16 would then be omitted. The bandpass filter 14 is provided if spectral information relating to the sensed residual noise is required. If full spectral information is required from the residual noise, the filter 14 could be replaced by bandpass filtering means having adjustable centre frequencies which would scan through the required spectrum under the control of the CPU 17 or under the control of an auxiliary microcomputer (not shown).

The proposed use of a completely analog active noise control system 4 in the present invention results in a far simpler and less expensive configuration than the known digital systems.

We claim:

1. An active noise control system, comprising:

(a) a duct through which noise to be controlled can propagate from a noise source;

(b) first receiving transducer means located to receive the propagated noise at a point in a plane perpendicular to the length of the duct;

(c) transmitting transducer means located substantially at said plane for introducing sound into the duct;

(d) analog first control means connected in a feedback loop with said first receiving transducer means and said transmitting transducer means and operative, in response to the noise received by said first receiving transducer means, for feeding a signal to the transmittng transducer means such that the sound introduced thereby destructively interferes with the noise at said point, said first control means including integrating circuit means having an electrically-controllable transfer function;

(e) second receiving transducer means located further from the noise source than said plane to receive residual noise propagated along the duct despite said destructive interference; and (f) second control means, responsive to the residual noise received by said second receiving transducer means, for controlling parameters of said first analog control means so a to minimize said residual noise.

2. A system a claimed in claim 1, wherein said first control means includes an attenuator circuit having an electrically-controllable attenuation factor.

3. A system as claimed in claim 1, wherein said second control means comprises an analog processor to which analog signals representing the received residual noise are fed.

4. A system a claimed in claim 1, wherein said second control means comprises a digital data processor to which digital signals representing the received residual noise are fed.

5. A system as claimed in claim 4, wherein said second control means comprises analog/digital converter means for converting analog signals from said second receiving transducer means into digital signals for feeding to the digital data processor.

6. A system as claimed in claim 1, wherein said second control means comprises a bandpass filter.

7. A system as claimed claim 6, wherein said bandpass filter has an electrically-controllable passband centre frequency.

8. A system as claimed in claim 1, wherein said first control means includes power amplifier means for driving the transmitting transducer.

9. A system as claimed in claim 1, wherein each of said first and second receiving transducer means comprises a microphone.

10. A system as claimed in claim 1, wherein the transmitting transducer comprises a loudpspeaker.

* * * * *